US011472619B2

(12) United States Patent
Slavin et al.

(10) Patent No.: US 11,472,619 B2
(45) **Date of Patent: *Oct. 18, 2022**

(54) CASELESS CONTAINER TRAY

(71) Applicants: DFA Dairy Brands IP, LLC, Dallas, TX (US); Dordan Manufacturing Co., Woodstock, IL (US)

(72) Inventors: Daniel J. Slavin, Village of Lakewood, IL (US); John Kreider, Woodstock, IL (US); Brett A. Johnson, Belvidere, IL (US)

(73) Assignee: DFA Dairy Brands IP, LLC, Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/941,135

(22) Filed: Jul. 28, 2020

(65) Prior Publication Data

US 2020/0354127 A1 Nov. 12, 2020

Related U.S. Application Data

(63) Continuation of application No. 15/716,213, filed on Sep. 26, 2017, now Pat. No. 10,730,676.

(Continued)

(51) Int. Cl.
*B65D 71/70* (2006.01)
*B65D 25/28* (2006.01)

(Continued)

(52) U.S. Cl.
CPC ..... *B65D 71/70* (2013.01); *B65D 1/36* (2013.01); *B65D 21/023* (2013.01);

(Continued)

(58) Field of Classification Search
CPC ..... B65D 85/80; B65D 71/70; B65D 21/023; B65D 1/36

(Continued)

(56) References Cited

U.S. PATENT DOCUMENTS 3,272,371 A 9/1966 Weiner
3,341,054 A 9/1967 Hirota (Continued)

FOREIGN PATENT DOCUMENTS

AU 198772167 11/1987
EP 0335730 A2 10/1989

(Continued)

*Primary Examiner* — Steven A. Reynolds
(74) *Attorney, Agent, or Firm* — Faegre Drinker Biddle & Reath LLP

(57) ABSTRACT

Embodiments of caseless container trays are disclosed. In an embodiment, a caseless container tray includes a top surface and a bottom surface. The top surface is configured to contact and receive base portions of a first plurality of containers. The top surface includes a plurality of top projections configured to divide the first plurality of containers into a plurality of rows. The bottom surface is configured to contact and receive spouts of a second plurality of containers. Furthermore, the bottom surface includes a plurality of bottom projections extending from the bottom surface, wherein a bottom surface of each bottom projection is configured to contact a shoulder portion of a container of the second plurality of containers and wherein each projection surrounds a center portion configured to contact and receive a spout.

18 Claims, 8 Drawing Sheets

Related U.S. Application Data

(60) Provisional application No. 62/401,120, filed on Sep. 28, 2016.

(51) Int. Cl.
*B65D 23/10* (2006.01)
*B65D 1/36* (2006.01)
*B65D 21/02* (2006.01)
*B65D 85/80* (2006.01)

(52) U.S. Cl.
CPC ..... *B65D 23/102* (2013.01); *B65D 25/2885* (2013.01); *B65D 85/80* (2013.01)

(58) Field of Classification Search
USPC ..... 206/561, 557; 220/519, 516, 513
See application file for complete search history.

(56) References Cited

U.S. PATENT DOCUMENTS 3,392,869 A 7/1968 Needt
3,589,511 A 6/1971 Britt
3,740,238 A 6/1973 Graham
3,896,239 A 7/1975 Peters
4,009,817 A 3/1977 Marshall et al.
4,161,259 A * 7/1979 Palafox ..... B65D 1/243 220/519
4,314,633 A 2/1982 Oliff
4,606,454 A 8/1986 Hambleton et al.
4,615,443 A 10/1986 Deffner et al.
4,735,321 A 4/1988 Day
4,750,623 A 6/1988 Flum
4,767,004 A 8/1988 Ishihara et al.
4,801,024 A 1/1989 Flum et al.
4,848,573 A 7/1989 Salacuse
4,860,888 A 8/1989 Keith
4,865,202 A 9/1989 Day
4,896,774 A 1/1990 Hammett et al.
4,930,632 A 6/1990 Eckert et al.
4,946,037 A 8/1990 Keith
4,998,023 A 3/1991 Kitts
5,014,862 A 5/1991 Bustos
5,016,761 A 5/1991 Stoddard et al.
5,036,976 A 8/1991 Sechler et al.
5,038,961 A 8/1991 Watanabe et al.
5,071,026 A 12/1991 Apps
5,147,039 A 9/1992 Sechler et al.
D336,406 S 6/1993 Wytiuk
5,266,369 A 11/1993 Ando et al.
5,360,112 A 11/1994 Beauchamp
5,377,862 A 1/1995 Oakes et al.
5,575,390 A 11/1996 Apps et al.
5,645,169 A * 7/1997 Dull ..... B65D 65/46 206/524.7
5,647,284 A 7/1997 Frysinger et al.
5,706,662 A 1/1998 Van
5,743,400 A 4/1998 Hansen et al.
5,882,173 A 3/1999 Ziegler
5,921,411 A 7/1999 Merl
6,021,913 A 2/2000 McGrath
6,076,697 A 6/2000 Allabaugh, Jr.
6,238,770 B1 5/2001 Moul
6,273,006 B1 8/2001 Reutter et al.
6,279,770 B1 8/2001 Osbakk et al.
6,530,476 B1 3/2003 Overholt
6,582,179 B1 6/2003 Simkowski
6,659,019 B2 12/2003 Gruber et al.
D485,452 S 1/2004 Boron et al.
6,685,036 B2 2/2004 De et al.
6,823,803 B2 11/2004 Preisler
6,851,563 B1 2/2005 Lipari
6,971,518 B1 12/2005 Lowry
7,089,871 B2 8/2006 Smith, Jr.
D542,780 S 5/2007 Nguyen et al.
7,267,060 B1 9/2007 Moser et al.
D569,196 S 5/2008 Angel et al.
7,677,405 B2 3/2010 Apps et al.
7,735,676 B2 6/2010 Ogburn
7,891,635 B2 2/2011 Rowland
7,984,806 B2 7/2011 Matheou
8,047,392 B2 11/2011 Eiten et al.
8,133,049 B1 3/2012 Sullivan et al.
D658,840 S 5/2012 Nadeau
8,235,214 B2 8/2012 Eiten et al.
D667,305 S 9/2012 Kuhn et al.
8,306,696 B2 11/2012 Holbrook et al.
D676,711 S 2/2013 Toufayan
8,403,144 B2 3/2013 Eiten
D684,002 S 6/2013 Cloutier
D684,419 S 6/2013 Cloutier et al.
8,517,190 B2 8/2013 Polizzi et al.
D689,350 S 9/2013 Sudmalis
D690,566 S 10/2013 Bernheim
8,640,892 B2 2/2014 Polizzi et al.
D701,418 S 3/2014 Tingley
9,010,255 B2 4/2015 Baltz
9,074,812 B2 7/2015 Rowland
9,080,786 B2 7/2015 Rowland
D744,341 S 12/2015 Prince
9,290,298 B2 3/2016 Linares
9,315,291 B2 4/2016 Kelly et al.
9,327,890 B1 5/2016 Connelly
9,395,034 B1 7/2016 Rowland et al.
9,409,688 B2 8/2016 Kelly et al.
9,410,731 B1 8/2016 Rowland
9,783,349 B2 10/2017 Buck et al.
9,809,366 B2 * 11/2017 Prince ..... B65B 21/02
10,000,321 B2 6/2018 Kelly et al.
2003/0082366 A1 5/2003 Preisler
2004/0255827 A1 12/2004 De Barros
2005/0042071 A1 2/2005 Kelly
2005/0103674 A1 5/2005 Matheou
2005/0115472 A1 6/2005 Smith, Jr.
2005/0279651 A1 12/2005 Perret et al.
2006/0060617 A1 3/2006 Facey et al.
2006/0102566 A1 5/2006 Kelly
2006/0144071 A1 7/2006 Rowland
2006/0272556 A1 12/2006 Apps
2007/0215014 A1 9/2007 Lee
2008/0023425 A1 1/2008 Ricciardi
2008/0029684 A1 2/2008 Rowland
2008/0116214 A1 5/2008 Apps et al.
2008/0135698 A1 6/2008 Gordon
2008/0314771 A1 12/2008 Barbalho et al.
2009/0057248 A1 3/2009 Vishnevsky
2009/0108002 A1 * 4/2009 Delbrouck ..... B65D 19/42 220/519
2009/0206088 A1 8/2009 Ogburn
2009/0301980 A1 12/2009 Buerger
2010/0030425 A1 2/2010 Holbrook et al.
2010/0108544 A1 5/2010 Biundo
2010/0132311 A1 6/2010 Apps et al.
2010/0193456 A1 8/2010 Polizzi et al.
2010/0213639 A1 8/2010 Ogburn
2011/0100268 A1 5/2011 Milkowski et al.
2013/0036707 A1 2/2013 Zacchi
2013/0233815 A1 9/2013 Lesbirel
2014/0174976 A1 6/2014 Ramberg et al.
2014/0283713 A1 9/2014 Baltz et al.
2015/0001114 A1 1/2015 Kelly et al.
2015/0191275 A1 7/2015 Linares
2016/0280415 A1 9/2016 McDonald et al.
2018/0086525 A1 3/2018 Johnson et al.
2019/0016516 A1 1/2019 Ludka et al.

FOREIGN PATENT DOCUMENTS

EP 0959011 A1 11/1999
EP 1623934 A1 2/2006
EP 2746182 A1 6/2014
EP 2855292 A1 4/2015
FR 2810866 A1 1/2002
FR 2873660 A1 2/2006
GB 2182020 A 5/1987

(56) References Cited

FOREIGN PATENT DOCUMENTS

| | | | |
|---|---|---|---|
| GB | 2291408 | A | 1/1996 |
| GB | 2327941 | A | 2/1999 |
| NL | 1001630 | C2 | 5/1997 |
| WO | 99/15429 | A1 | 4/1999 |
| WO | 2003/106316 | A1 | 12/2003 |
| WO | 2004/014754 | A1 | 2/2004 |
| WO | 2008/028732 | A1 | 3/2008 |
| WO | 2013/004248 | A1 | 1/2013 |
| WO | 2013/178226 | A1 | 12/2013 |
| WO | 2014/108697 | A1 | 7/2014 |
| WO | 2014/135594 | A1 | 9/2014 |
| WO | 2016/004435 | A1 | 1/2016 |

* cited by examiner

CASELESS CONTAINER TRAY

CROSS-REFERENCE TO RELATED APPLICATIONS

This application is a continuation of U.S. patent application Ser. No. 15/716,213 filed Sep. 26, 2017, which claims priority to U.S. Provisional Application No. 62/401,120 filed Sep. 28, 2016, both of which are herein incorporated by reference in its entirety.

TECHNICAL FIELD

The present disclosure relates generally to a caseless container tray for shipping a plurality of containers containing one or more substances. More specifically, the present disclosure relates to a caseless container tray that can be used to ship a plurality of containers without requiring external packaging or sidewalls to hold the containers in place and/or support the weight of the containers.

BACKGROUND

Some substances, such as liquids, may be distributed from a manufacturer to a retailer in containers that may easily be handled and transported by the retailer and/or an end consumer. The capacity of these containers may be several gallons or less such that handling and transport of a container does not create an undue burden to the retailer and/or end consumer. Since the capacity of these containers may be several gallons or less, a plurality of containers may be shipped together.

SUMMARY

In an Example 1, a container tray comprises: a top surface configured to contact and receive base portions of a first plurality of containers, wherein the top surface comprises a plurality of top projections configured to divide the first plurality of containers into a plurality of rows, wherein each row of the plurality of rows is configured to receive at least two containers of the first plurality of containers; and a bottom surface configured to contact and receive spouts of a second plurality of containers, wherein the bottom surface comprises a plurality of bottom projections extending from the bottom surface, wherein a bottom surface of each bottom projection is configured to contact a shoulder portion of a container of the second plurality of containers and wherein each projection surrounds a center portion, wherein each center portion is configured to contact and receive a spout of the spouts.

In an Example 2, the container tray of Example 1, wherein the top surface further comprises cavities having inner surfaces that have substantially similar contours as outer surfaces of the plurality of projections extending from the bottom surface.

In an Example 3, the container tray of Example 2, further comprising at least one ridge bisecting each of the plurality of cavities, wherein a first ridge of the at least one ridge extends from a first end of a respective cavity to a center portion of the cavity and a second ridge of the least one ridge extends from the center portion to a second end of the respective cavity, wherein the first end is opposite the second end.

In an Example 4, the container tray of Example 3, wherein the at least one ridge has a uniform thickness.

In an Example 5, the container tray of Example 3, wherein the at least one ridge has a non-uniform thickness.

In an Example 6, the container tray of Example 3, wherein the first and second ridges have different thicknesses and/or shapes.

In an Example 7, the container tray of Example 3, wherein the at least one ridge has a thickness than is less than a diameter of the center portion.

In an Example 8, the container tray of Example 1, wherein the plurality of projections extending from the bottom surface include structures extending from sidewalls of the plurality of projections configured to increase stability of the plurality of projections.

In an Example 9, the container tray of Example 1, further comprising sidewalls surrounding and extending from the top surface.

In an Example 10, the container tray of Example 9, wherein each sidewall comprises at least one projection extending substantially perpendicular from the sidewall, wherein the at least one projection is configured to create an airgap between the container tray and a second container tray when the container tray and the second container tray are in a stacked configuration.

In an Example 11, the container tray of Example 9, wherein the sidewall has a height of less than 1.5 inches.

In an Example 12, the container tray of Example 9, wherein the plurality of top projections have a height that is equal to or less than a height of the sidewall.

In an Example 13, the container tray of Example 9, wherein corners of the sidewall include a curvature that substantially matches a curvature of the first plurality of containers.

In an Example 14, a container tray comprises: a surface having a plurality of rows separated by dividers, wherein each row of the plurality of rows is configured to receive bases of at least two containers and wherein each divider is configured to separate the bases of the at least two containers in a first row of the plurality of rows from bases of containers located in a second row of the plurality of rows; wherein a bottom surface of the surface includes a plurality of projections, wherein the plurality of projections are configured to receive spouts of a second plurality of containers and wherein the plurality of projections form a clearance fit with shoulder portions of the spouts.

In an Example 15, the container of Example 14, wherein a top surface of the surface includes a planar surface and cavities extending downward from the planar surface and wherein the cavities have substantially similar contours as the plurality of projections.

In an Example 16, the container of Example 15, wherein each cavity includes a center portion that is substantially planar with the planar surface.

In an Example 17, the container of Example 15, further comprising at least one ridge bisecting each of the cavities, wherein a first ridge of the at least one ridge extends from a first end of a respective cavity to a center portion of the cavity and a second ridge of the least one ridge extends from the center portion to a second end of the respective cavity, wherein the first end is opposite the second end.

In an Example 18, the container tray of Example 17, wherein the at least one ridge has a uniform thickness.

In an Example 19, the container tray of Example 17, wherein the at least one ridge has a non-uniform thickness.

In an Example 20, the container tray of Example 17, wherein the at least one ridge has a thickness than is less than a diameter of the center portion.

While multiple embodiments are disclosed, still other embodiments of the present disclosure will become apparent to those skilled in the art from the following detailed description, which shows and describes illustrative embodiments of the disclosed subject matter. Accordingly, the drawings and detailed description are to be regarded as illustrative in nature and not restrictive.

Figure 1:
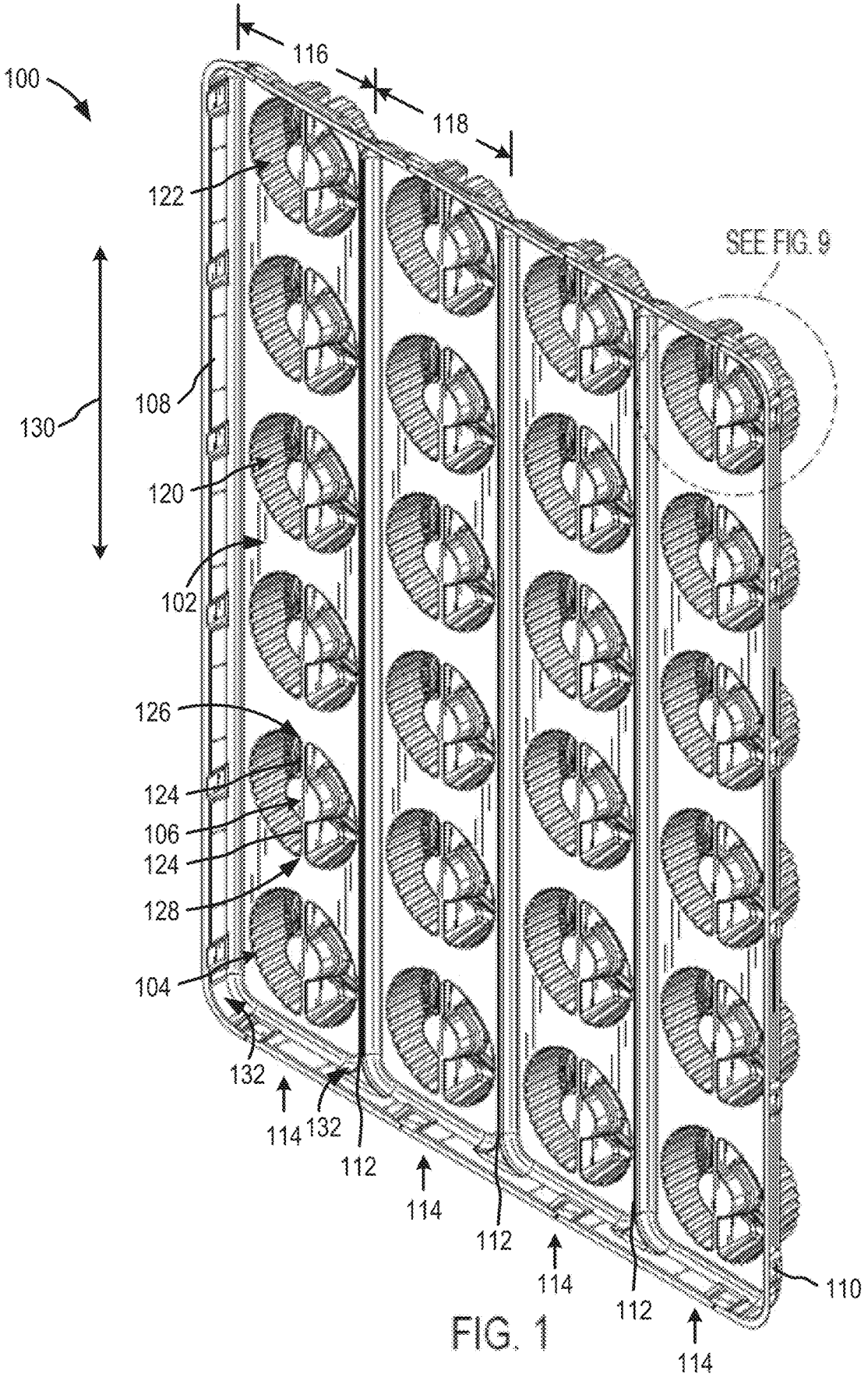
FIG. 1 is a perspective view of the top side of a caseless container tray, in accordance with the embodiments of the present disclosure.

Although the term "block" may be used herein to connote different elements illustratively employed, the term should not be interpreted as implying any requirement of, or particular order among or between, various blocks disclosed herein. Similarly, although illustrative methods may be represented by one or more drawings (e.g., flow diagrams, communication flows, etc.), the drawings should not be interpreted as implying any requirement of, or particular order among or between, various steps disclosed herein. However, certain embodiments may require certain steps and/or certain orders between certain steps, as may be explicitly described herein and/or as may be understood from the nature of the steps themselves (e.g., the performance of some steps may depend on the outcome of a previous step). Additionally, a "set," "subset," or "group" of items (e.g., inputs, algorithms, data values, etc.) may include one or more items, and, similarly, a subset or subgroup of items may include one or more items. A "plurality" means more than one.

DETAILED DESCRIPTION

While the disclosed subject matter is amenable to various modifications and alternative forms, specific embodiments have been shown by way of example in the drawings and are described in detail below. The intention, however, is not to limit the disclosed subject matter to the particular embodiments described. On the contrary, the disclosed subject matter is intended to cover all modifications, equivalents, and alternatives falling within the scope of the disclosed subject matter as defined by the appended claims.

As the terms are used herein with respect to ranges of measurements (such as those disclosed immediately above), "about" and "approximately" may be used, interchangeably, to refer to a measurement that includes the stated measurement and that also includes any measurements that are reasonably close to the stated measurement, but that may differ by a reasonably small amount such as will be understood, and readily ascertained, by individuals having ordinary skill in the relevant arts to be attributable to measurement error, differences in measurement and/or manufacturing equipment calibration, human error in reading and/or setting measurements, adjustments made to optimize performance and/or structural parameters in view of differences in measurements associated with other components, particular implementation scenarios, imprecise adjustment and/or manipulation of objects by a person or machine, and/or the like.

Conventional embodiments used to ship a plurality of containers have either generally included sidewalls or packaging, such as plastic wrap, to hold the containers in place. The sidewalls may also support the weight of any crates and/or containers that were placed on top of a crate. These conventional embodiments have had some drawbacks. With regard to the use of crates, a person trying to remove a container from the crate would have to lift the container the height of the sidewall to remove the container from the crate which, in many cases, is higher than the height of the container. This created excess and work on the part of the employee. In regards to using plastic wrap, the plastic wrap may become damaged during transportation and, as a result, come containers may no longer be held in place by the plastic wrap. The embodiments disclosed herein may alleviate some of these burdens.

Figure 2:
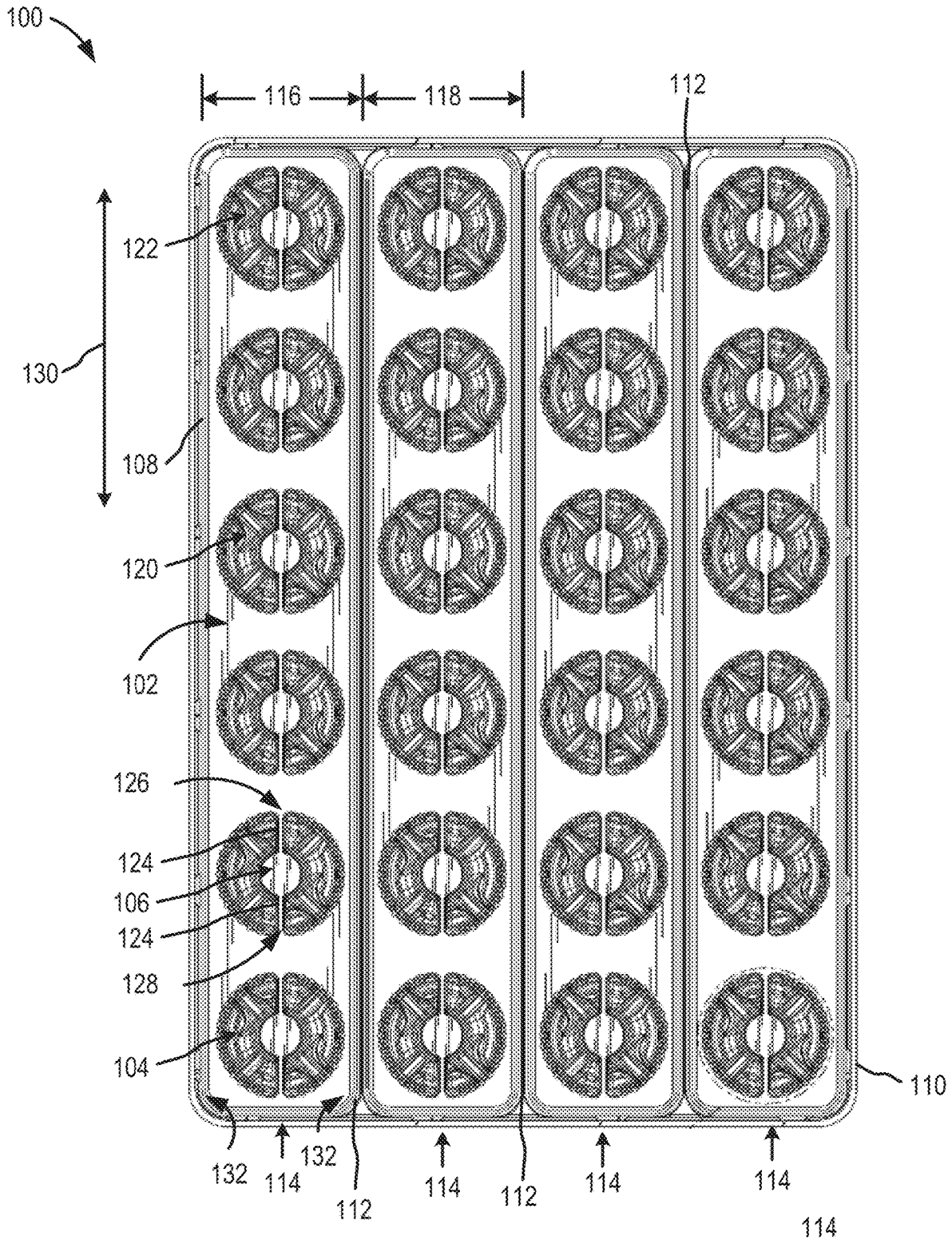
FIG. 2 is a top view of the caseless container tray depicted in FIG. 1, in accordance with embodiments of the present disclosure.

FIG. 1 is a perspective view of the top side of a caseless container tray 100 and FIG. 2 is a top view of the caseless container tray depicted in FIG. 1, in accordance with the embodiments of the present disclosure. In embodiments, the caseless container tray 100 may thermally formed out of a material that enables a user of the caseless container tray 100 to reuse the caseless container tray 100, wash the caseless container tray 100 and/or return the caseless container tray 100 to a manufacturer, so that a manufacturer can reuse the caseless container tray 100. Examples of materials that the caseless container tray 100 may be made out of include, but are not limited to: High Impact Polystyrene, Acrylonitrile Butadiene Styrene, Polyethylene Terephthalate (e.g., Amorphous Polyethylene Terephthalate, recycled Polyethylene Terephthalate, Polyethylene terephthalate glycol-modified), High Density Polyethylene and Polyvinyl Chloride. Additionally or alternatively, the caseless container tray 100 may be approximately 0.1 inches thick, 0.2 inches thick, 0.3 inches thick, 0.4 inches thick, etc.

Figure 11:
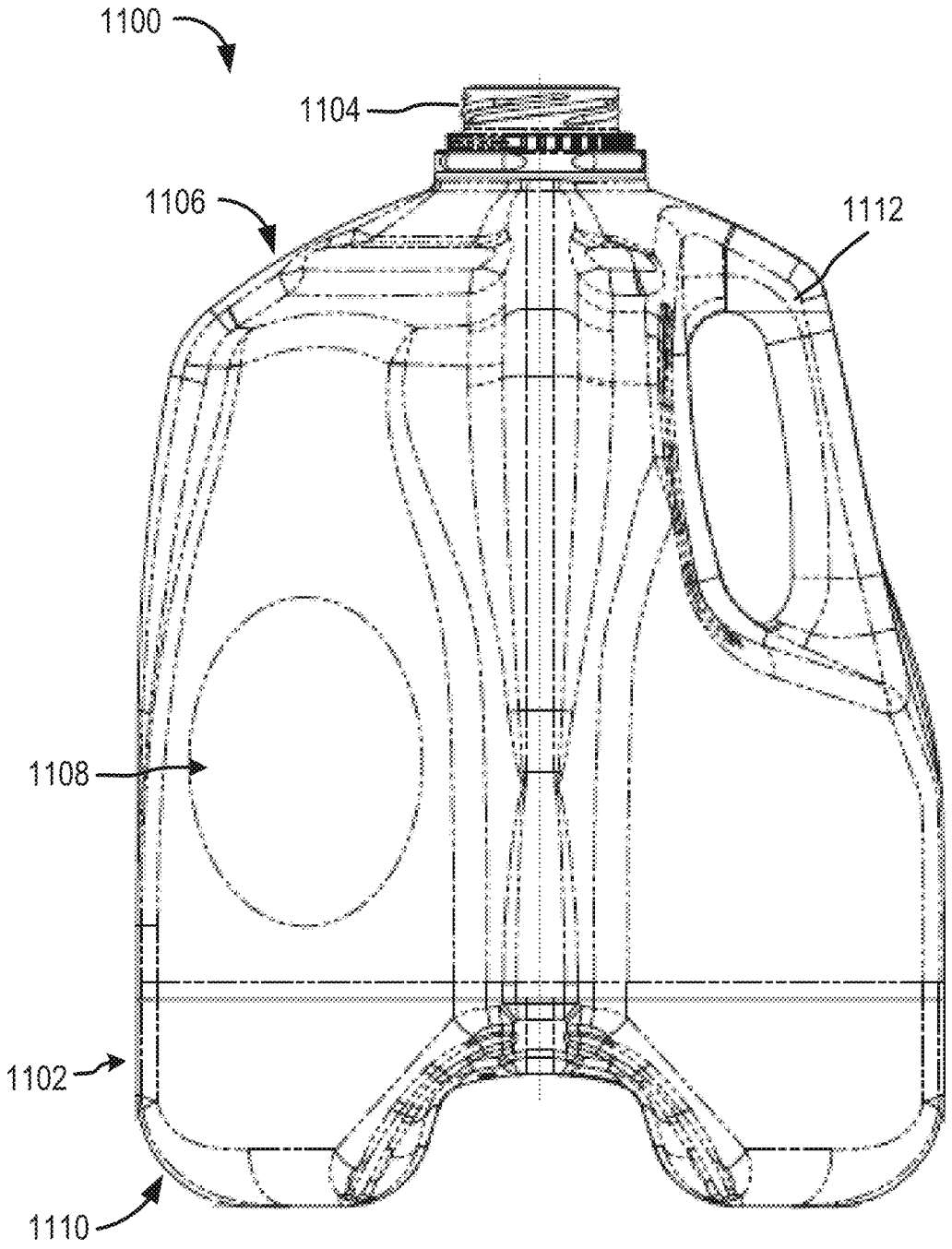
FIG. 11 a side of an example container that can be used with the caseless container tray depicted in FIGS. 1-8.

The caseless container tray 100 is configured to receive base portions of a plurality of containers. An example container 1100 is depicted in FIG. 11 and reference may be made to FIG. 11 when describing certain aspects of the containers. However, the container 1100 (of FIG. 11) is only an example and not meant to be limiting. Instead, the caseless container tray 100 may be used with any container configured to contain a substance, for example, a liquid, solid or gas. In an example, the container 1100 may be a container to contain milk. In embodiments, the containers may be stackable and configured to support the weight of other caseless container trays 100 that are stacked on top of the containers 1100 (of FIG. 11). Further details of embodiments of containers are disclosed, for example, in U.S. Pat. No. 8.047,392, entitled "Stackable Liquid Containers," U.S.

Pat. No. 8,235,214, entitled "Stackable Liquid Container with Tunnel-Shaped Base," and U.S. Pat. No. 8,403,144, entitled "Liquid Container: System for Distribution," which are hereby incorporated by reference in their entireties.

The top side of the caseless container tray 100 may include a planar surface 102 that receives the base portions 1102 (of FIG. 11) of containers 1100 (of FIG. 11). In embodiments, the caseless container tray 100 may include cavities 104 and a respective container may be placed over each cavity 104 of the caseless container tray 100. While the embodiments depicted show a plurality of cavities 104, in embodiments, the caseless container tray 100 may have a flat top surface without any of the cavities 104.

In embodiments, a cavity 104 may include two parts, a left part and a right part, as depicted in FIGS. 1-10. Alternatively, a cavity 104 may be one continuous cavity or a plurality of parts. In embodiments, the size of the cavity 104 may be smaller than the base portion 1102 (of FIG. 11), so that the base portion 1102 (of FIG. 11) does not fall into the cavity but instead is supported by the planar surface 102. In embodiments, the cavity 104 may include a center portion 106. The bottom side of the center portion may be configured to receive and contact a spout 1104 (of FIG. 11) of a container 1100 (of FIG. 11), as described in more detail below in relation to FIGS. 3 and 4. Additionally or alternatively, the shape of the cavity may be configured so that the bottom side of the cavity contacts the shoulder portion 1106 (of FIG. 11) of a container 1100 (of FIG. 11), so that the shoulder portion 1106 (of FIG. 11) can support any other caseless container trays 100 that are stacked on top of the container, as described in more detail below in relation to FIGS. 3 and 4.

In some embodiments, the caseless container tray 100 includes a sidewall 108 that surrounds the planar surface 102. The sidewall 108 may be configured to retain the base portion 1102 (of FIG. 11) of the containers 1100 (of FIG. 11) on the planar surface 102. In embodiments, the sidewall 108 may have a height that allows a label 1108 (of FIG. 11) of a container 1100 (of FIG. 11) to be viewable while the containers 1100 (of FIG. 11) are disposed on the caseless container tray 100. For example, the sidewall 108 may be approximately equal to or less than 0.25 inches, 0.5 inches, 0.75 inches, 1.25 inches, 1.5 inches, etc. However, these are only examples and not meant to be limiting.

In embodiments, the sidewalls 108 may include one or more projections 110 that extend in a direction approximately perpendicular from the sidewalls 108. When containers are not stacked on the caseless container trays 100, but the caseless container trays 100 are stacked on one another, for example, when a plurality of caseless container trays 100 are being shipped or stored, the projections may create an air gap between the caseless container trays 100. As such, once containers are ready to be stacked on the caseless container trays 100, a user and/or robot may more easily separate the caseless container trays 100 from one another. In embodiments, the projections may have a rectangular shape and/or any other shape that may facilitate the separation of the caseless container trays 100 from one another.

In some embodiments, the top side of the caseless container tray 100 includes dividers 112 that divide and retain the containers 1100 (of FIG. 11) in rows 114. In embodiments, the distance 116 from a first row of the rows 114 to a sidewall 108 and/or the distance 118 from a first row of the rows 114 to a second row of the rows 114 may be sized to receive base portions 1102 (of FIG. 11) of a container 1100 (of FIG. 11). In addition, however, the distance 116 from a first row of the rows 114 to a sidewall 108 and/or the distance 118 from a first row of the rows 114 to a second row of the rows 114 may be sized so that the base portions 1102 (of FIG. 11) of the containers 1100 (of FIG. 11) cannot pivot, rotate and/or twist once the container is placed in a row 114. That is, for example, the distance 116 from a first row of the rows 114 to a sidewall 108 and/or the distance 118 from a first row of the rows 114 to a second row of the rows 114 may be sized to form approximately a transition fit and/or a clearance fit with the base portion 1102 (of FIG. 11) of a container 1100 (of FIG. 11).

In embodiments, the dividers 112 may be approximately the same height as the sidewall 108. Alternatively, the dividers 112 may be taller or shorter than the sidewalls 108. For example, the dividers 112 may approximately equal to or less than 0.25 inches, 0.5 inches, 0.75 inches, 1.25 inches, 1.5 inches etc. While four rows 114 are shown, fewer or more rows 114 may be included in the caseless container tray 100. For example, the caseless container tray 100 may include one row 114, two rows 114, three rows 114, four rows 114, five 114, six rows 114, seven rows 114, eight rows 114, etc. Additionally or alternatively, while six cavities 104 are shown in each row, fewer or more cavities 104 may be included in each row 114. For example, each row may include two cavities 104, three cavities 104, four cavities 104, five cavities 104, six cavities 104, seven cavities 104, eight cavities 104, etc. In embodiments, the caseless container tray 100 may include a number of rows and cavities so that a specific number of caseless container trays 100 fit on a pallet. In embodiments, the caseless container tray 100 may have a slight overhang on one or more sides of the pallet.

Additionally or alternatively, the rows 114 may enable a user to slide a container 1100 (of FIG. 11) from one position of a row 114 (e.g., from position 120) to another position of a row 114 (e.g., to position 122) without having to lift the container 1100 (of FIG. 11). To facilitate sliding a container 1100 (of FIG. 11) from one position of a row 114 to another position of a row 114, the cavities 104 may include a ridge 124 that extends from a first side 126 of the cavity 104 to the center portion 106 and from the center portion 106 to a second side 128 of the cavity 104. In embodiments, the first and second sides 126, 128 may be opposite one another and/or the ridge 124 may extend in a direction 130 that is parallel to the rows 114. As such, when a user is sliding a container from a first position (e.g., from position 120) to a second position (e.g., to position 122), the edge of the container will not fall into the cavity 104. Additionally or alternatively, the ridge 124 may add structural integrity to the center portion 106, so that the center portion 106 does not compress.

In embodiments, the ridges 124 may have a uniform thickness that extends from the first side 126 of the cavity to the center portion 106 and from the center portion 106 to the second side of the cavity 104. Alternatively, the ridges 124 may have a non-uniform thickness (or width) that extends from the first side 126 of the cavity to the center portion 106 and from the center portion 106 to the second side of the cavity 104. While the ridges 124 on each side of the center portion 106 are shown to be of similar thicknesses and shapes, they may have different thicknesses and/or shapes. In embodiments, the thickness of the ridge 124 may be less than the diameter of the center portion 106. Alternatively, the thickness of the ridge 124 may be greater than the diameter of the center portion 106. Additionally, the ridges 124 may be straight and parallel to one or more adjacent dividers 112, or the ridges 124 may have an irregular shape that is either parallel or non-parallel to the adjacent dividers 112.

In embodiments, in addition to or exclusive of the center portion 106, the ridges 124 may separate the cavities 104 into a first part and a second part, as depicted in FIGS. 1-10. However, in other embodiments that do not include a ridge 124 and/or a center portion 106, the cavities 104 may be a single continuous cavity.

Additionally or alternatively, the corners 132 of the ends of the rows may have a curvature that matches the curvature of the corners 1110 (of FIG. 11) of the base portions 1102 (of FIG. 11) of the containers 1100 (of FIG. 11). This may allow a user to slide a container 1100 (of FIG. 11) to an end of a row 114 to facilitate removing the container 1100 (of FIG. 11) from the row 114. Additionally or alternatively, the rows 114 may add structural integrity to the caseless container tray 100, so that the caseless container tray 100 does not bend as easily along a direction 132 that is parallel to the rows 114.

Figure 3:
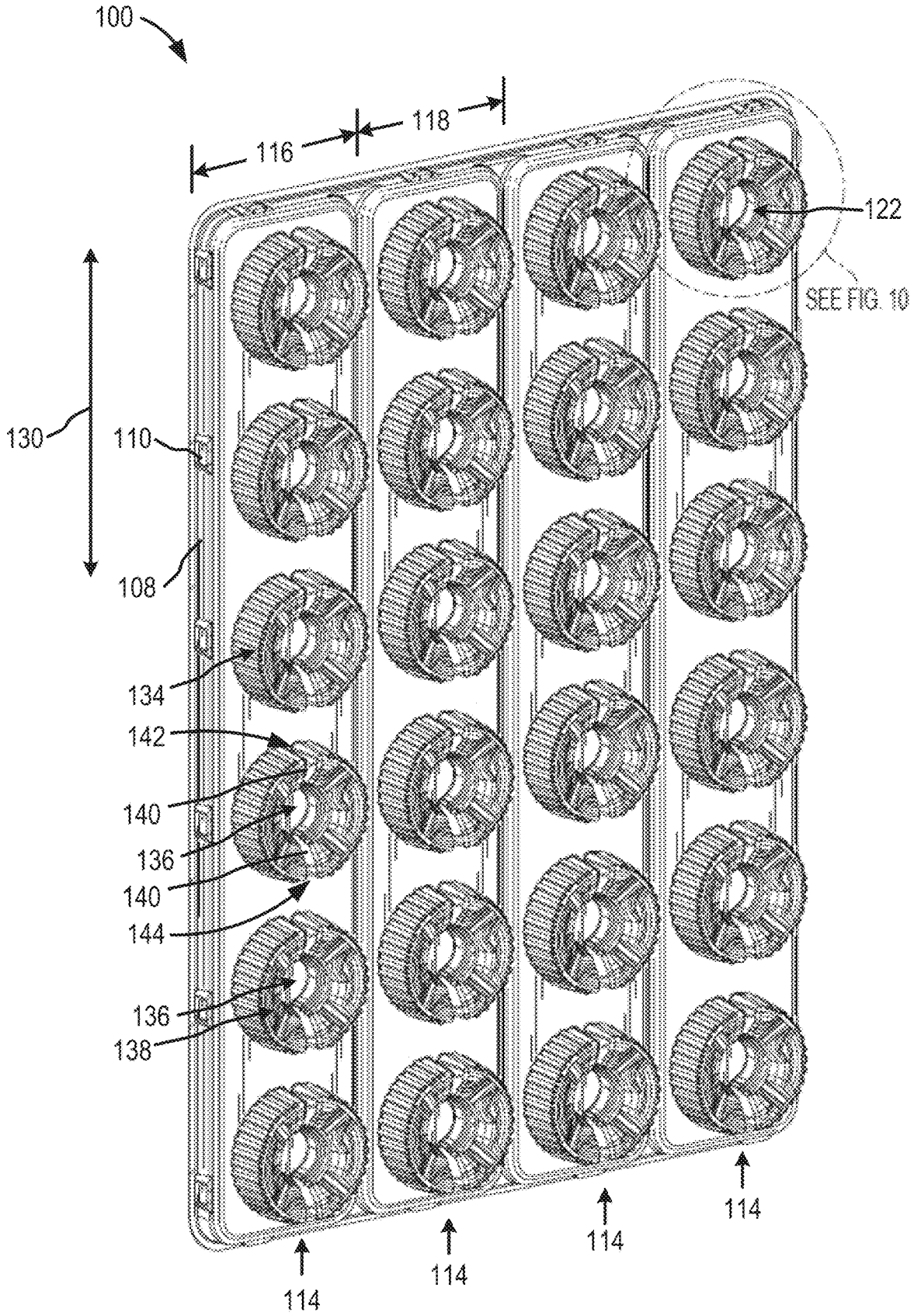
FIG. 3 is a perspective view of the bottom side of the caseless container tray depicted in FIGS. 1 and 2, in accordance with embodiments of the present disclosure.
Figure 4:
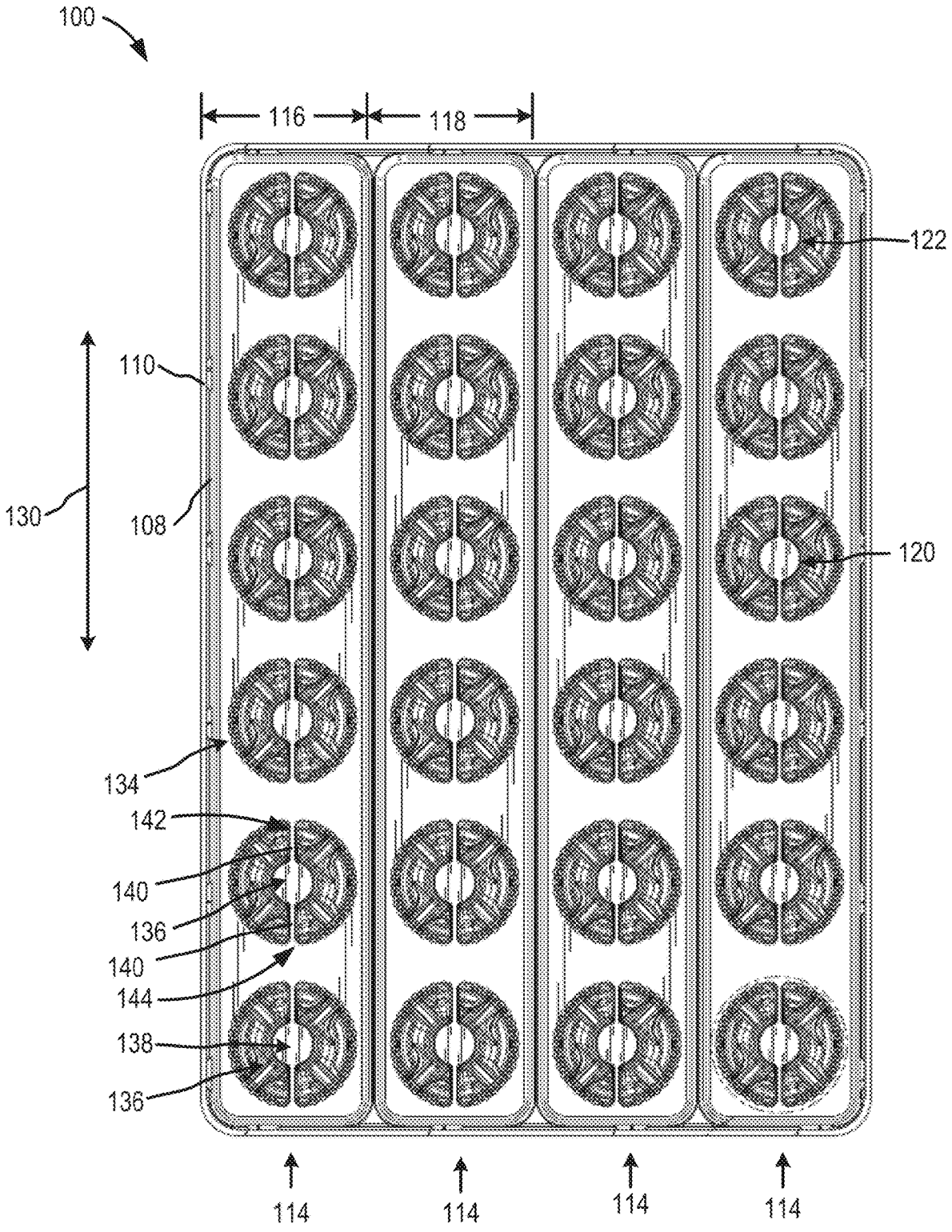
FIG. 4 is a bottom view of the caseless container tray depicted in FIGS. 1-3, in accordance with embodiments of the present disclosure.

FIG. 3 is a perspective view of the bottom side of the caseless container tray depicted in FIGS. 1 and 2 and FIG. 4 is a bottom view of the caseless container tray depicted in FIGS. 1-3, in accordance with embodiments of the present disclosure. The bottom side of the caseless container tray 100 includes projections 134. The projections 134 are configured to receive the top portions of containers 1100 (of FIG. 11). In embodiments, the cavities 104 and the projections 134 may be thermally formed, so that the outer portions of the projections 134 have substantially the same shape the inner portions of the cavities 104. Alternatively, the caseless container tray 100 may only include projections 134 and not include cavities 104.

The projections 134 are configured to surround a center portion 136. The center portion 136 is configured to receive and contact a spout 1104 (of FIG. 11) of a container 1100 (of FIG. 11). Additionally, the projection 134 is formed so that a bottom portion 138 of the projection 134 contacts a shoulder portion 1106 (of FIG. 11) of the container 1100 (of FIG. 11). In embodiments, the shoulder portion 1106 (of FIG. 11) may be the strongest portion of the container 1100 (of FIG. 11); and, therefore, the shoulder portions 1106 (of FIG. 11) of a plurality of containers 1100 (of FIG. 11) may be capable of supporting a caseless container tray 100 on top of the containers and/or containers disposed on the caseless container tray 100. In embodiments, the bottom portion 138 may be formed differently to fit different shapes of shoulder portions 1106 that a container 1100 may have.

Additionally or alternatively, the projections 134 may include indentations 140 that extend from a first side 142 of the projection 134 to the center portion 136 and from the center portion 136 to a second side 144 of the projection. In embodiments, an indentation 140 may be sized to receive a handle 1112 (of FIG. 11) of a container 1100 (of FIG. 11). As such, when the indentation 140 receives a handle 1112 (of FIG. 11), the container 1100 (of FIG. 11) may be prevented from twisting, pivoting, and/or rotating. In embodiments, the first and second sides 142, 144 may be opposite one another and/or the indentations 140 may extend in a direction 130 that is parallel to the rows 114.

Figure 5:
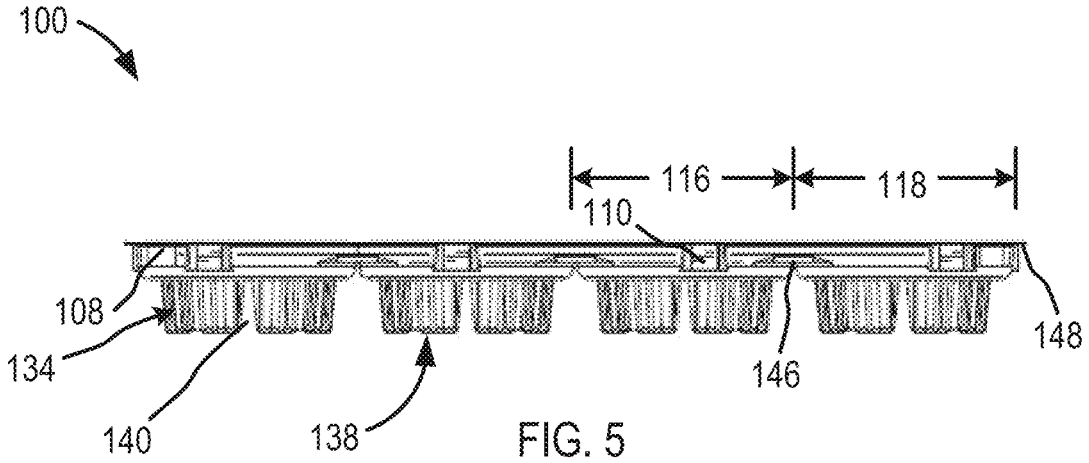
FIGS. 5 and 6 are end view of the caseless container tray depicted in FIGS. 1-4, in accordance with embodiments of the present disclosure.
Figure 6:
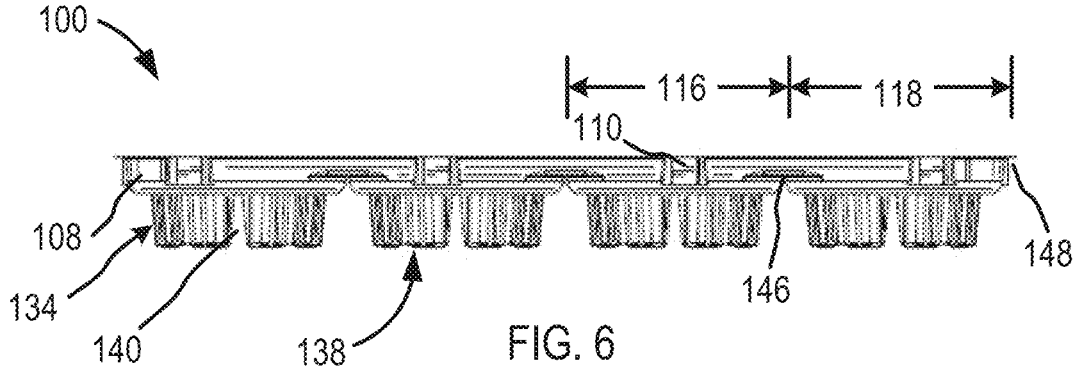

FIGS. 5 and 6 are end view of the caseless container tray depicted in FIGS. 1-4, in accordance with embodiments of the present disclosure. As shown, in embodiments, the caseless container tray 100 may include a bridge structure 146 that bridges the portion of the caseless container tray 100 where the dividers are formed. In embodiments, the bridge structure 146 may add structural stability to the caseless container tray 100 so that one row 114 does not fold over and/or onto another row 114. Additionally or alternatively, the sides of the caseless container tray 100 may include a flange 148. The flange may facilitate separation of the caseless container trays 100 from one another by a user and/or a robot.

Figure 7:
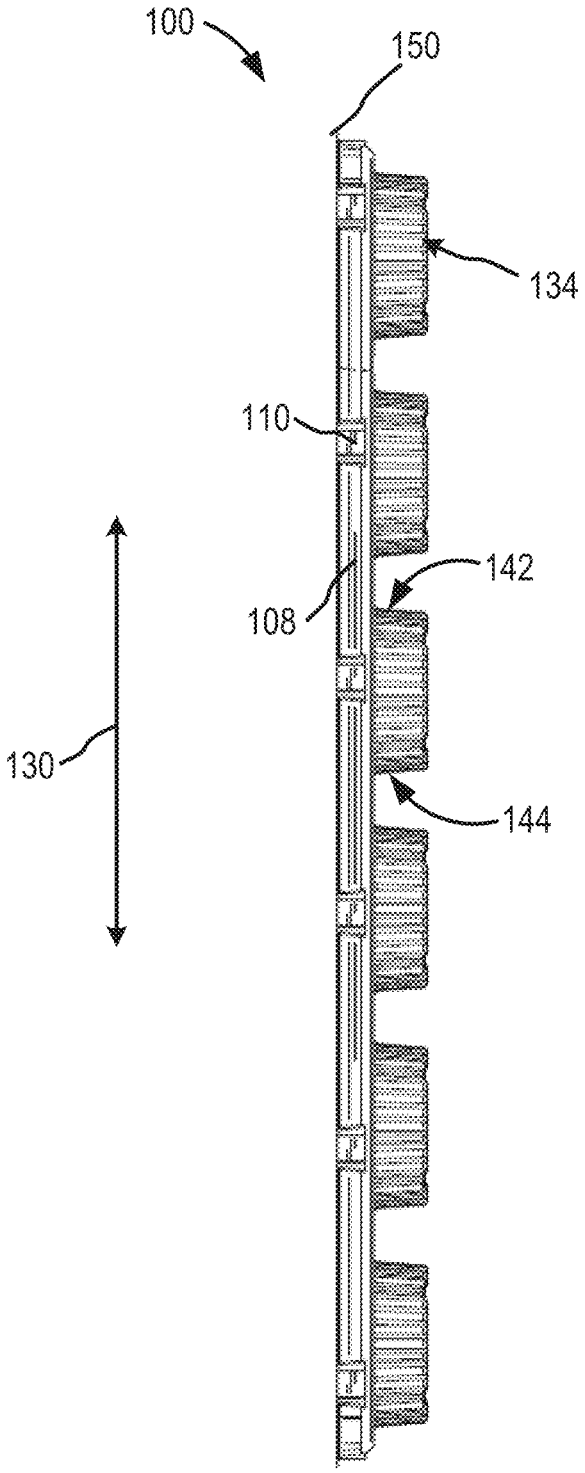
FIGS. 7 and 8 are side views of the caseless container tray depicted in FIGS. 1-6, in accordance with embodiments of the present disclosure.
Figure 8:
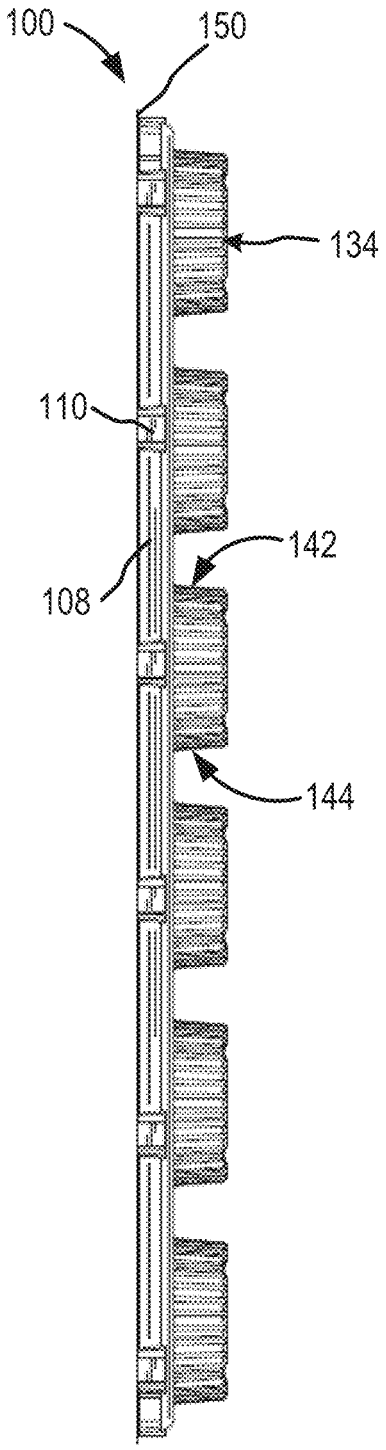

FIGS. 7 and 8 are side views of the caseless container tray depicted in FIGS. 1-6, in accordance with embodiments of the present disclosure. As shown, the ends of the caseless container tray 100 may include a flange 150. Similar to the flanges 148 depicted in FIGS. 5 and 6, the flanges 150 may facilitate separation of the caseless container trays 100 from one another by a user and/or a robot.

Figure 9:
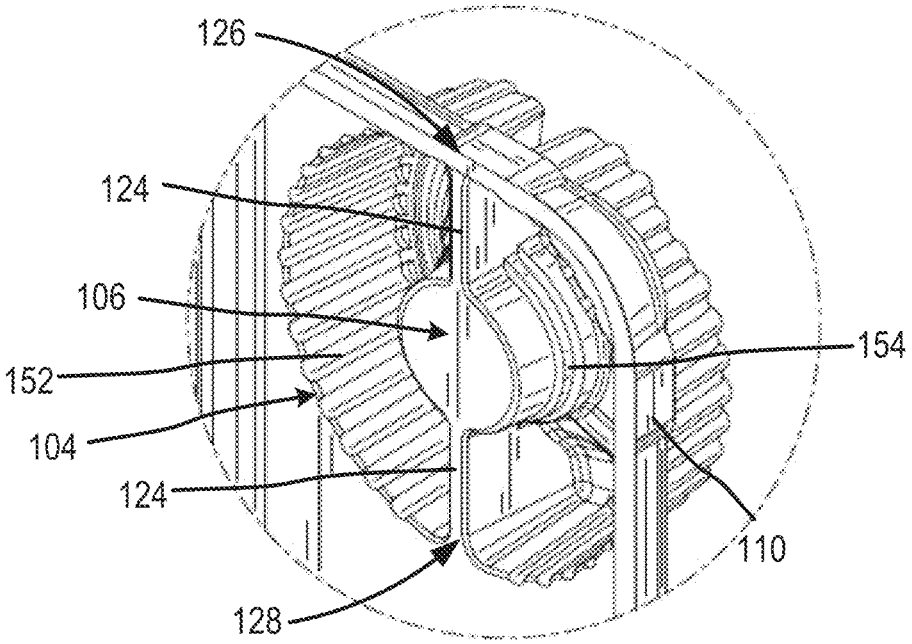
FIG. 9 is a perspective view of the top side of a portion of the caseless container tray depicted in FIGS. 1-8, in accordance with embodiments of the present disclosure.

FIGS. 9 is a perspective view of the top side of a portion of the caseless container tray depicted in FIGS. 1-8, in accordance with embodiments of the present disclosure. The portion depicted is a close-up view of a cavity 104 that is disposed on the corner of the caseless container tray 100. In embodiments, the cavity 104 may include ridges 152 extending down the sides of the cavity. The ridges 152 may add structural integrity to the cavity 104. Additionally or alternatively, the center portion 106 may include ridges 154. Similar to the ridges 152, the ridges 154 may add structural integrity to the center portion 106.

Figure 10:
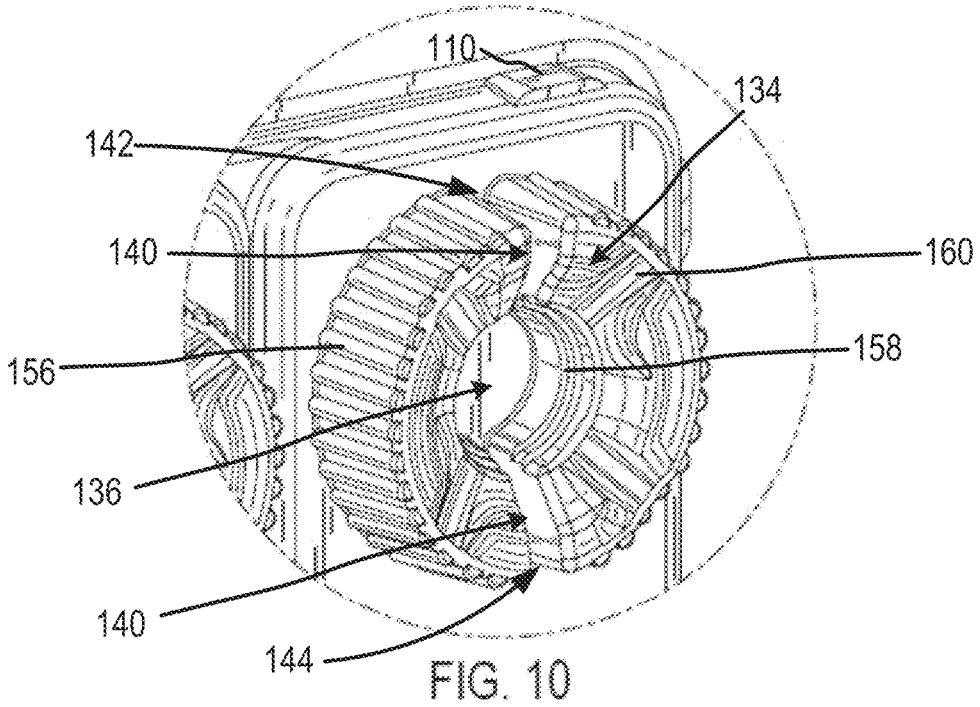
FIG. 10 is a perspective view of the bottom side of a portion of the caseless container tray depicted in FIGS. 1-8, in accordance with embodiments of the present disclosure.

FIG. 10 is a perspective view of the bottom side of a portion of the caseless container tray depicted in FIGS. 1-8, in accordance with embodiments of the present disclosure. The portion depicted is a close-up view of a projection 134 that is disposed on the corner of the caseless container tray 100. As stated above, the cavity 104 and the projection 134 may be thermally formed, so that the outer portions of the projection 134 have substantially the same shape as the inner portions of the cavities 104. Alternatively, the caseless container tray 100 may only include projections 134 and not include cavities 104.

In embodiments, the projection 134 may include ridges 156 extending down the sides of the projection 134. The ridges 156 may add structural integrity to the projection 134. Additionally or alternatively, the center portion 136 may include ridges 158. Similar to the ridges 156, the ridges 158 may add structural integrity to the center portion 136.

Various modifications and additions can be made to the exemplary embodiments discussed without departing from the scope of the present disclosure. For example, while the embodiments described above refer to particular features, the scope of this disclosure also includes embodiments having different combinations of features and embodiments that do not include all of the described features. Accordingly, the scope of the present disclosure is intended to embrace all such alternatives, modifications, and variations as fall within the scope of the claims, together with all equivalents thereof.

What is claimed is:

1. A container tray comprising:

a top surface configured to receive base portions of a first plurality of containers, wherein the top surface comprises a plurality of cavities, wherein each of the plurality of cavities comprises a left part and a right part, wherein the top surface comprises a corresponding planar area that extends continuously between adjacent cavities of the plurality of cavities, wherein the left part and the right part of each of the plurality of cavities is bisected by a top ridge surface of at least one ridge, and wherein the top ridge surface is coplanar with the corresponding planar area; and a bottom surface configured to receive spouts of a second plurality of containers.

2. The container tray of claim 1, further comprising a plurality of dividers projecting from the top surface and configured to divide the first plurality of containers into a plurality of rows.

3. The container tray of claim 1, wherein the bottom surface comprises a plurality of bottom projections extending from the bottom surface, wherein a bottom surface of each bottom projection is configured to contact a shoulder portion of a container of the second plurality of containers and wherein each bottom projection surrounds a center portion, wherein each center portion is configured to contact and receive a spout of the spouts.

4. The container tray of claim 1, wherein a first ridge of the at least one ridge extends from a first end of a respective cavity to a center portion of the cavity and a second ridge of the least one ridge extends from the center portion to a second end of the respective cavity, wherein the first end is opposite the second end.

5. The container tray of claim 1, wherein the at least one ridge has a uniform thickness.

6. The container tray of claim 1, wherein the at least one ridge has a non-uniform thickness.

7. The container tray of claim 4, wherein the first and second ridges have different thicknesses and/or shapes.

8. The container tray of claim 4, wherein the at least one ridge has a thickness that is less than a diameter of the center portion.

9. The container tray of claim 3, wherein the plurality of bottom projections extending from the bottom surface include structures extending from sidewalls of the plurality of bottom projections configured to increase stability of the plurality of projections.

10. The container tray of claim 1, further comprising sidewalls surrounding and extending from the top surface.

11. The container tray of claim 10, wherein each sidewall comprises at least one projection extending from the sidewall, wherein the at least one projection is configured to create an airgap between the container tray and a second container tray when the container tray and the second container tray are in a stacked configuration.

12. The container tray of claim 10, wherein the sidewall has a height of less than 1.5 inches.

13. The container tray of claim 11, wherein the at least one projection extending from the sidewall has a height that is equal to or less than a height of the sidewall.

14. The container tray of claim 10, wherein corners of the sidewall include a curvature that substantially matches a curvature of the first plurality of containers.

15. A container tray comprising:

a top surface configured to contact and receive bases of a first plurality of containers, wherein the top surface comprises a plurality of cavities, wherein the top surface com prises a corresponding planar area between each pair of the plurality of cavities, wherein each cavity of the plurality of cavities comprises a center portion that is substantially planar with the corresponding planar area, and wherein each of the plurality of cavities is bisected by a top ridge surface of at least one ridge, and the top ridge surface is coplanar with the corresponding planar area; and a bottom surface configured to receive spouts of a second plurality of containers, the bottom surface comprising a plurality of bottom projections extending from the bottom surface, wherein a lower surface of each bottom projection is configured to contact a shoulder portion of a container of the second plurality of containers and wherein each bottom projection surrounds one of the center portions, wherein each center portion is configured to contact and receive one of the spouts.

16. The container tray of claim 15, wherein the top surface comprises a plurality of dividers separating the top surface into a plurality of rows.

17. The container of claim 15, wherein a first ridge of the at least one ridge extends from a first end of a cavity of the plurality of cavities to the center portion of the cavity and a second ridge of the at least one ridge extends from the center portion to a second end of the cavity, wherein the first end is opposite the second end.

18. The container tray of claim 17, wherein the first ridge and the second ridge have a thickness that is less than a diameter of the center portion.

* * * * *